US008851606B2

(12) United States Patent
Takeda

(10) Patent No.: US 8,851,606 B2
(45) Date of Patent: Oct. 7, 2014

(54) INKJET IMAGE RECORDING APPARATUS

(75) Inventor: Kazuya Takeda, Kyoto (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 44 days.

(21) Appl. No.: 13/571,064

(22) Filed: Aug. 9, 2012

(65) Prior Publication Data

US 2013/0169709 A1 Jul. 4, 2013

(30) Foreign Application Priority Data

Dec. 28, 2011 (JP) ..... 2011-287196

(51) Int. Cl.
*B41J 29/38* (2006.01)

(52) U.S. Cl.
USPC ..... 347/14; 347/5; 347/9; 347/19

(58) Field of Classification Search
CPC ..... B41J 29/38
See application file for complete search history.

(56) References Cited

U.S. PATENT DOCUMENTS

| | | | | |
|---|---|---|---|---|
| 5,353,052 | A * | 10/1994 | Suzuki et al. | 347/19 |
| 7,095,531 | B2 * | 8/2006 | Mizes et al. | 358/1.9 |
| 7,327,503 | B2 * | 2/2008 | Yashima et al. | 358/504 |
| 2003/0086100 | A1 | 5/2003 | Yashima et al. | |
| 2005/0099446 | A1 | 5/2005 | Mizes et al. | |
| 2006/0279597 | A1 | 12/2006 | Ishimoto et al. | |
| 2006/0285135 | A1 * | 12/2006 | Mestha et al. | 358/1.9 |
| 2008/0211850 | A1 | 9/2008 | Miyamoto et al. | |
| 2011/0090276 | A1 * | 4/2011 | Hirano | 347/14 |
| 2011/0157273 | A1 * | 6/2011 | Tendler et al. | 347/19 |

FOREIGN PATENT DOCUMENTS

| | | | |
|---|---|---|---|
| EP | 1308279 | A2 | 5/2003 |
| EP | 1944170 | A2 | 7/2008 |
| JP | 2006-346938 | A | 12/2006 |

OTHER PUBLICATIONS

Search Report issued in European Patent Application No. 12178438.3 dated Mar. 22, 2013.

* cited by examiner

*Primary Examiner* — Manish S Shah
*Assistant Examiner* — Jeremy Delozier
(74) *Attorney, Agent, or Firm* — McDermott, Will and Emery LLP

(57) ABSTRACT

A chart 50 is formed of a density detecting pattern 51 and position detecting marks 52. The density detecting pattern 51 includes five different density areas A, B, C, D and E in form of belts arranged sequentially in Y-direction. The position detecting marks 52 are formed at intervals in X-direction which is a direction of arrangement of nozzles, at an end of the density area A of the density detecting pattern 51. These position detecting marks 52 are formed by suspending, for a fixed period of time, discharge from particular nozzles selected from a plurality of nozzles which discharge ink for forming the density detecting pattern 51, thereby producing ink-free portions (void portions) in the density area A.

6 Claims, 6 Drawing Sheets

INKJET IMAGE RECORDING APPARATUS

BACKGROUND OF THE INVENTION

1. Field of the Invention

This invention relates to an inkjet image recording apparatus for carrying out head shading, and a chart for use in the head shading.

2. Description of the Related Art

A printing apparatus (image recording apparatus) which performs printing in an inkjet mode includes a recording head having a plurality of recording elements arranged thereon. Images are formed on a recording medium such as paper by discharging ink from each recording element (nozzle). The recording elements arranged on the recording head of this type of printing apparatus have variations in characteristic resulting from the manufacturing process, constituent material, and so on of the recording head. The variations in characteristic of the recording elements manifest themselves in uneven size and density of ink droplets discharged from the recording elements, which causes a density unevenness of recorded images. Thus, a printing apparatus has been proposed which reduces such density unevenness by correcting the density unevenness (this correction being called head shading) based on density data obtained by printing a density detecting pattern on paper and reading the density detecting pattern with a scanner, for example (see Japanese Unexamined Patent Publication No. 2006-346938).

For carrying out the head shading, it is necessary to read the density detecting pattern with a scanner or the like, and correlate an ink density in an ink landing position within the density detecting pattern, with the position of each nozzle of the recording head that has discharged the ink to that landing position. In Japanese Unexamined Patent Publication No. 2006-346938, ink is discharged from one particular nozzle to print a test pattern having upper or lower ruled lines projecting from the density detecting pattern. By using projecting portions of the upper ruled lines or lower ruled lines as a nozzle position detecting pattern, each nozzle is correlated with each dot in the density detecting pattern. That is, each nozzle is correlated with density data.

The recording head of the printing apparatus described in Japanese Unexamined Patent Publication No. 2006-346938 has a relatively small number of nozzles, and performs printing by reciprocating the recording head a plurality of times relative to printing paper. The test pattern of this Unexamined Patent Publication No. 2006-346938, when modified to be applicable to a printing apparatus that performs what is called one-pass printing with a recording head having numerous nozzles arranged in a transverse direction (X-direction) of printing paper movable in one direction (+Y-direction), will become chart 150 shown in FIG. 6. Chart 150 shown in FIG. 6 is intended to illustrate the problem of a technique (assumed technique) tried by Inventor herein, and is not prior art.

Chart 150 for head shading, with a position detecting pattern 152 formed therein, shown in FIG. 6, includes a density detecting pattern 151 having a plurality of belt-like density areas arranged in Y-direction and corresponding to a plurality of discharge rates (e.g. 90%, 70%, 50%, 30%, and 10%), and the position detecting pattern 152 formed by ink discharged from particular nozzles and projecting from the density detecting pattern 151. These patterns 151 and 152 are formed on printing paper. The position detecting pattern 152 includes a plurality of lines 153 each formed of ink droplets discharged from one particular nozzle to extend in a direction (Y-direction) perpendicular to a direction of arrangement (X-direction) of the nozzles.

The density detecting pattern of the chart for head shading needs to form a plurality of density areas having a constant width in Y-direction in order to secure the accuracy of density measurement. On the other hand, a margin area for printing the chart may become narrow due to restrictions of paper size, printed image size, and so on. Conventional chart 150 shown in FIG. 6 has the position detecting pattern 152 formed outside the density detecting pattern 151, and thus the margin needed for printing the chart is enlarged by an amount corresponding to the area for printing the position detecting pattern 152. Therefore, depending on the paper size or the like, the chart cannot be printed, which could make head shading impossible.

With chart 150 having the position detecting pattern 152 formed outside the density detecting pattern 151 by discharging ink from one particular nozzle to white printing paper, there occurs a problem that an image of the position detecting pattern 152 read by a scanner becomes indistinct due to flare. In such a case, a printing apparatus having a scanner of resolution higher than recording resolution (e.g. of resolution four times the recording resolution) can determine positions of the lines 153 accurately by obtaining, from an image read by the scanner, a distribution of gray scale values (density distribution) of formation areas of the lines 153 of the position detecting pattern 152 which serve as positional reference of the nozzles, and obtaining a center of gravity position from the distribution (see Japanese Unexamined Patent Publication No. 2006-346938, FIG. 14 and paragraph [0067]). However, a printing apparatus having a scanner of the same resolution as the recording resolution, positions of the lines 153 must be determined from an indistinct image, which will lower the accuracy of positioning of the nozzles.

Further, when discharging ink from one particular nozzle for forming the position detecting pattern 152, there could occur a phenomenon called deviation in which the direction of ink discharge inclines. In such a case, the following problem arises even with the printing apparatus having a scanner of resolution higher than the recording resolution. Even if a distribution of gray scale values (density distribution) of formation area of each line 153 of the position detecting pattern 152 corresponding to one particular nozzle, as in Japanese Unexamined Patent Publication No. 2006-346938, variations in landing position of the ink on the printing paper will spread the distribution of gray scale values, thereby making it difficult to determine the center of gravity position accurately. Then, the accuracy of positioning of the nozzles will lower.

SUMMARY OF THE INVENTION

The object of this invention, therefore, is to provide an inkjet image recording apparatus and a chart, which realize a space-saving of an area for printing the chart, and also enable an accurate determination of nozzle positions.

The above object is fulfilled, according to this invention, by an inkjet image recording apparatus with a recording head having a plurality of nozzles arranged transversely of a recording medium for discharging ink, the recording medium being transported relative to and in a direction perpendicular to a direction of arrangement of the nozzles, the apparatus correcting an ink discharge amount from each nozzle by detecting density of a chart formed by the recording head, the apparatus comprising a chart printing device for printing the chart having, recorded therein, a density detecting pattern with a plurality of density areas arranged in the transport direction of the recording medium by discharging the ink toward the recording medium at different discharge rates from the nozzles, and position detecting marks formed in a particular one of the density areas by suspending discharge from particular nozzles selected from the plurality of nozzles; an imaging device for acquiring an image of the chart; and a discharge correcting device for correcting the ink discharge amount from each nozzle using image data of the chart acquired by the imaging device.

According to such an inkjet image recording apparatus, the position detecting marks are formed in a particular one of the density areas of the density detecting pattern by suspending discharge from particular nozzles. Thus, the chart can be printed in a reduced area.

In a preferred embodiment, the recording head is formed of a plurality of inkjet heads each having an arrangement of numerous nozzles for discharging the ink, and the position detecting marks are formed by suspending discharge from at least one of the nozzles of each inkjet head.

Other features and advantages of the invention will be apparent from the following detailed description of the embodiments of the invention.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

DESCRIPTION OF THE PREFERRED EMBODIMENTS

Figure 1:
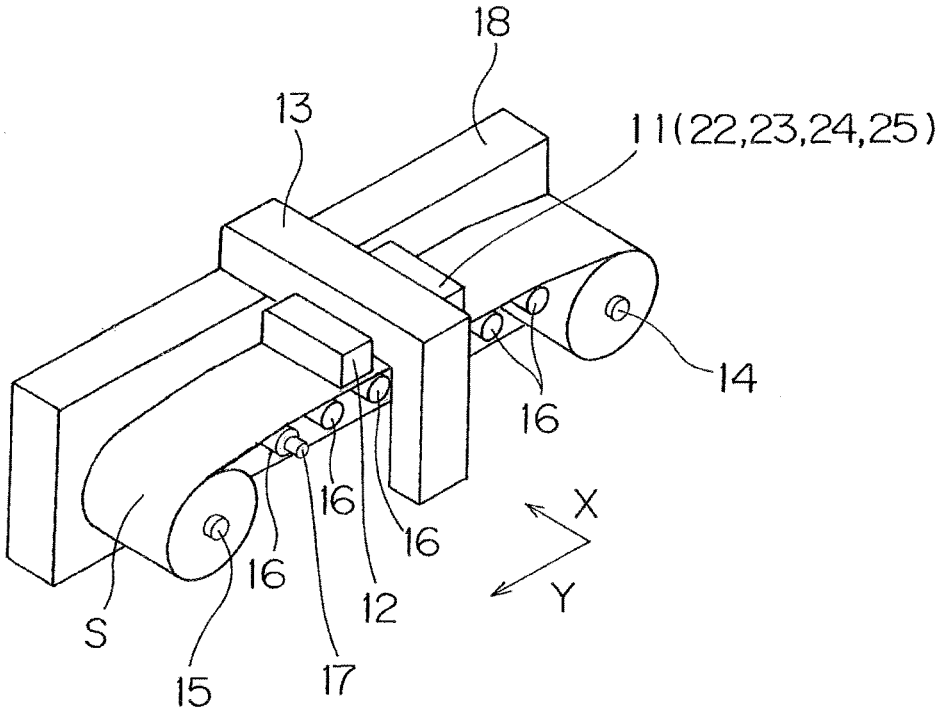
FIG. 1 is a perspective view of an inkjet image recording apparatus according to this invention.

An embodiment of this invention will be described hereinafter with reference to the drawings. An entire construction of an inkjet image recording apparatus to which this invention is applied will be described first. FIG. 1 is a perspective view schematically showing a side of the inkjet image recording apparatus according to this invention.

This inkjet image recording apparatus is constructed to record images with a recorder 11 having recording heads 22, 23, 24 and 25 on elongated printing paper S transported in Y-direction by action of a feed roller 14 having the printing paper S in a rolled form, a takeup roller 15 for winding up the printing paper S after image recording, and a plurality of transport rollers 16. This recorder 11 is supported along with an image reader 12 by a frame 13 attached to a base block 18.

The four recording heads include a recording head 22 for black ink, a recording head 23 for cyan ink, a recording head 24 for magenta ink, and a recording head 25 for yellow ink. These recording heads 22, 23, 24 and 25 are arranged over the printing paper S moving in Y-direction. Each of these recording heads 22, 23, 24 and 25 has numerous nozzles described hereinafter, which are arranged in a direction perpendicular to the moving direction of the printing paper S. The inks are discharged from these nozzles onto the printing paper S to record images.

The image reader 12 includes a scanner having a CCD image sensor, and is constructed to measure densities of an entire printed image and a chart 50 printed for head shading, which will be described hereinafter. Head shading refers to adjustment of an amount of discharge (rate of discharge) of the ink outputted from each nozzle for printing on the printing paper S, in order to eliminate variations in the amount of discharge among the nozzles of the recording heads 22, 23, 24 and 25.

Figure 2:
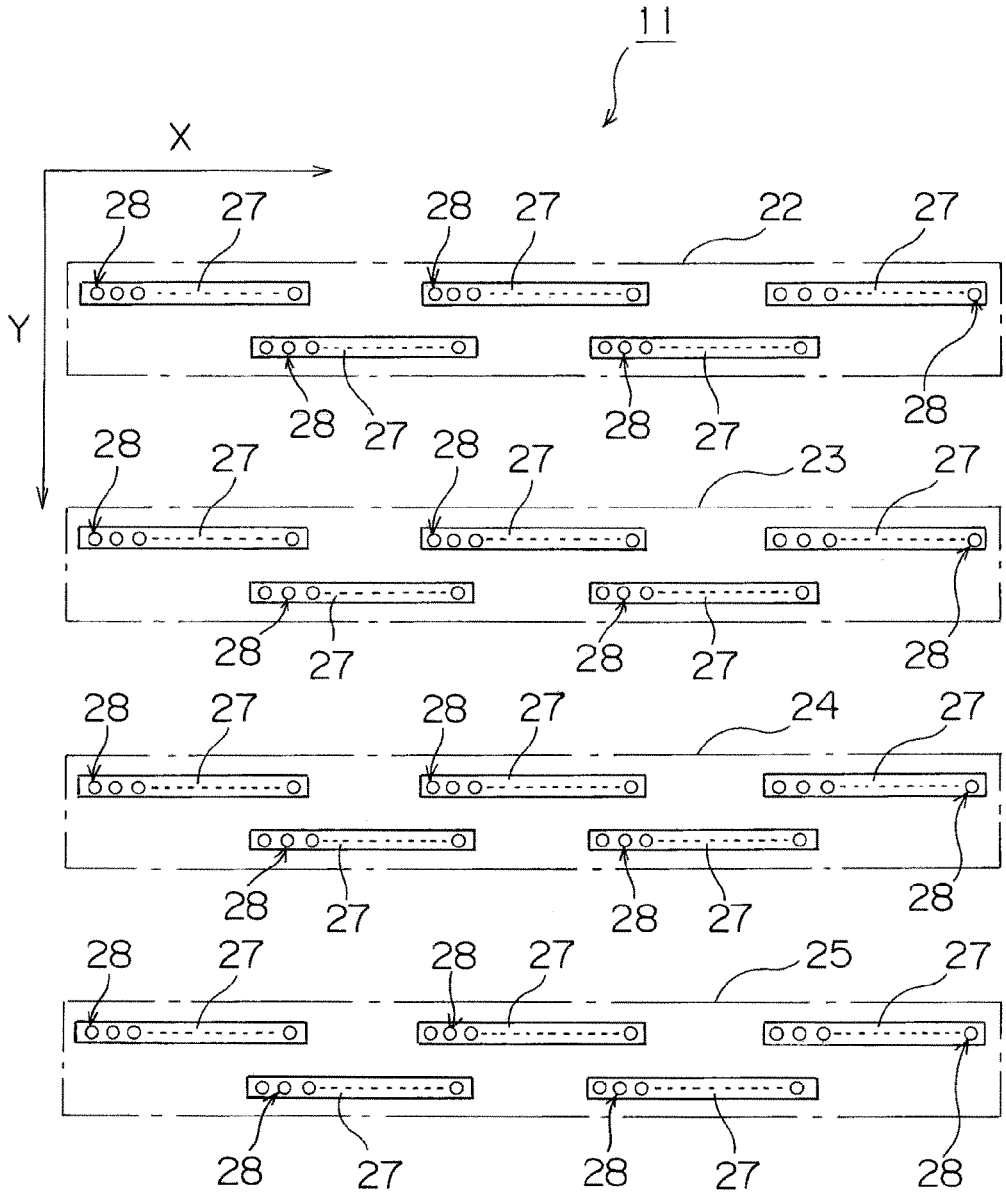
FIG. 2 is an explanatory view schematically showing a construction of a recording head.

Next, the construction of recording heads 22, 23, 24 and 25 will be described. FIG. 2 is an explanatory view schematically showing the construction of recording heads 22, 23, 24 and 25.

Each of these recording heads 22, 23, 24 and 25 has a plurality of inkjet heads 27 arranged to extend zigzag in X-direction. That is, the inkjet heads 27 are arranged in X-direction with their positions changed alternately in Y-direction. Each inkjet head 27 has a plurality of (e.g. 1000 to 2000) nozzles 28 arranged in X-direction for discharging ink. Consequently, the recording heads 22, 23, 24 and 25 have a construction with numerous ink discharge nozzles 28 arranged in X-direction (transversely of the printing paper S).

In FIG. 2, each of the recording heads 22, 23, 24 and 25 includes five inkjet heads 27, but the number of inkjet heads 27 is not limited to five. Each recording head may include a larger number of (e.g. 20) inkjet heads 27. The inkjet image recording apparatus with such recording heads 22, 23, 24 and 25 performs what is called one-pass printing which completes image recording as the printing paper S passes once under the recorder 11, by discharging the inks to the printing paper S in movement from the nozzles 28 arranged for each ink color over the transverse direction of printing paper S.

Figure 3:
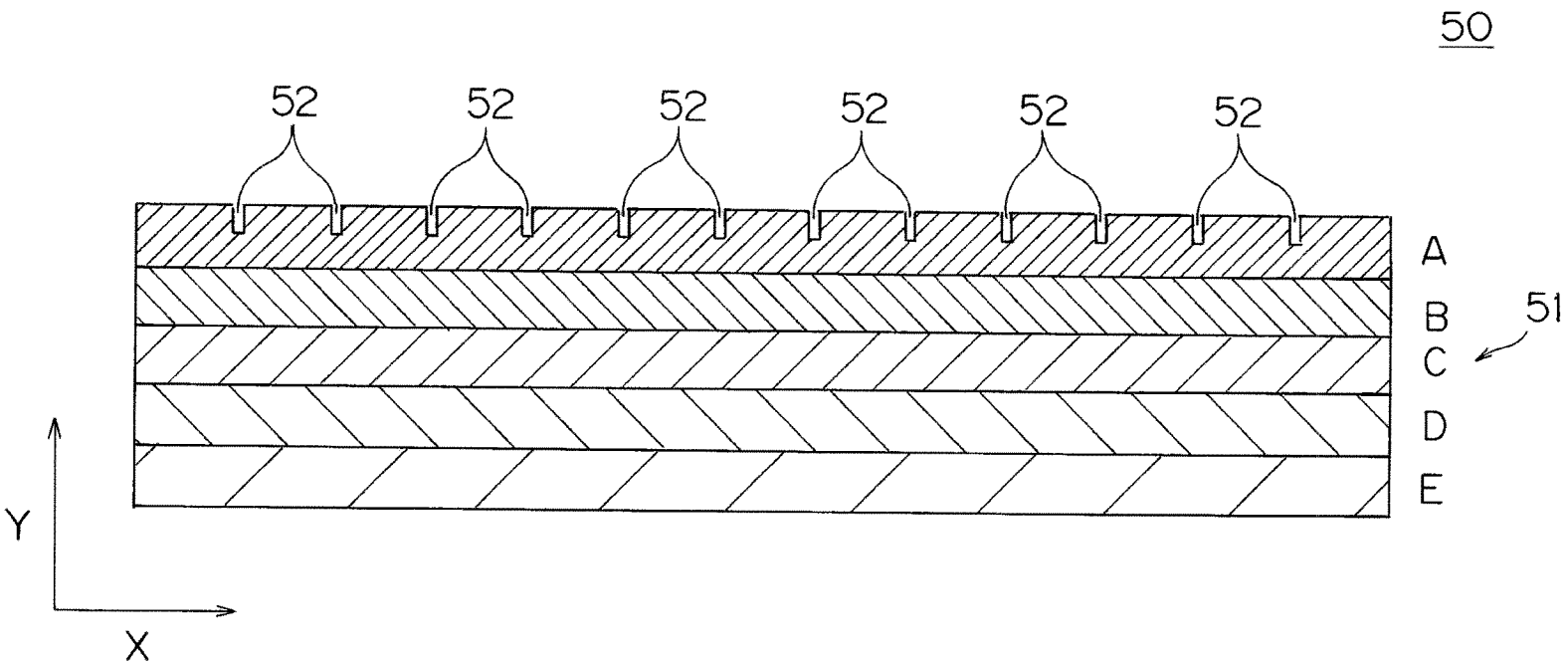
FIG. 3 is an explanatory view of a chart.

Next, the chart 50 for use in head shading, which is a characterizing feature of this invention, will be described. FIG. 3 is an explanatory view of the chart 50.

The chart 50 for head shading is printed by each of the recording heads 22, 23, 24 and 25 on the printing paper S for each ink color of black, cyan, magenta and yellow. FIG. 3 shows one of these. This chart 50 is formed of a density detecting pattern 51 and position detecting marks 52.

The density detecting pattern 51 is formed, with respect to X-direction, substantially over an entire printing area within the width of the printing paper S. The density detecting pattern 51 includes five different density areas A, B, C, D and E with a constant width (length) in form of belts arranged sequentially in Y-direction. This density detecting pattern 51 is formed by discharging ink at different discharge rates from the plurality of nozzles 28 arranged transversely of the printing paper S, to positions on the printing paper S corresponding to the respective density areas A, B, C, D and E. For example, under discharge control from a controller 40 to be described hereinafter, the ink discharge rate of each nozzle 28 is set to 90% when recording the density area A, 70% when recording the density area B, 50% when recording the density area C, 30% when recording the density area D, and 10% when recording the density area E. While the five density areas A, B, C, D and E are recorded to form this density detecting pattern 51, the number of density areas is not limited to this.

The position detecting marks 52 are formed at intervals in X-direction which is the direction of arrangement of the nozzles 28, at an end of the density area A (an end away from the end bordering on the other density area B) which serves as the leading end of the density detecting pattern 51 in the transport direction of the printing paper S (Y-direction). These position detecting marks 52 are formed by suspending, for a fixed period of time, discharge from particular nozzles 28 selected from the plurality of nozzles 28 which discharge ink for forming the density detecting pattern 51, thereby producing ink-free portions (void portions) in the density area A. The position detecting marks 52 are formed as shown in FIG. 3, by suspending, for the fixed period of time, discharge from the particular nozzles 28 selected on the basis of one nozzle from every 500 nozzles, such as the 1st, 501st, 1001st, and so on counted from left in FIG. 2, for example. The width in X-direction of each position detecting mark 52 corresponds to one nozzle 28, and the length in Y-direction of each position detecting mark 52 is about half the length in Y-direction of the density area A.

The length in Y-direction of each position detecting mark 52, preferably, is about ⅓ to ½ of the length in Y-direction of the density area in which the position detecting marks 52 are formed. That is, this chart 50 is used to determine density for head shading by imaging the density detecting pattern 51, and therefore from the viewpoint of maintaining the accuracy of head shading, a point of density measurement when ink is discharged at a predetermined discharge rate from each nozzle 28 must fully be secured. When the length in Y-direction of each position detecting mark 52 is about ⅓ to ½ of the length in Y-direction of the density area in which the position detecting marks 52 are formed, there occurs no possibility of impairing the role of the density detecting pattern to enable detection of density data of a landing position of ink on the printing paper S corresponding to the nozzle 28 having discharged the ink at the predetermined discharge rate.

The intervals in X-direction between the position detecting marks 52 (intervals between the nozzles 28 suspended from discharge) need not be constant intervals, but what is necessary is at least knowledge of the numbers in order of the nozzles 28 suspended from discharge. In this inkjet image recording apparatus, each of the recording heads 22, 23, 24 and 25 includes a plurality of inkjet heads 27. Thus, from the viewpoint of control on the basis of each inkjet head 27, it is preferable to form the position detecting marks 52 by suspending discharge from at least one nozzle 28 in each inkjet head 27. This facilitates determination of positions of the nozzles 28 from the position detecting marks 52, and also determination of arrangement of the inkjet heads 27.

With this chart 50, the position detecting marks 52 are formed in the density area A to which ink is discharged at the highest discharge rate from the nozzles 28 among the density areas A, B, C, D and E in the density detecting pattern 51. This is done in order to capture vividly the ink-free portions formed by suspending discharge from the nozzles, i.e. images of the position detecting marks 52, from images read by the image reader 12. Therefore, the position detecting marks 52, preferably, are formed in the density area recorded by discharging ink from the nozzles 28 at 70% or higher discharge rate. When the position detecting marks 52 are formed in the density area recorded by discharging ink from the nozzles 28 at 70% or higher discharge rate, the background to the position detecting marks 52 has a deep color, which has little chance of flare to render the images of the position detecting marks 52 indistinct. Therefore, even when the scanner of the image reader 12 has resolution equivalent to recording resolution, for example, the position detecting marks 52 can be detected accurately.

Figure 4:
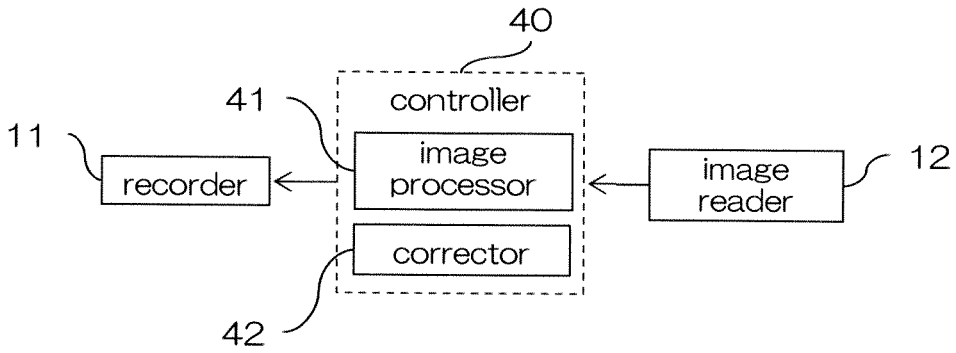
FIG. 4 is a block diagram showing a main construction relating to head shading of this inkjet image recording apparatus.

Next, head shading using the above chart 50 will be described. FIG. 4 is a block diagram showing a main construction relating to head shading of this inkjet image recording apparatus.

This inkjet image recording apparatus includes a controller 40 having, mounted therein, a RAM and a ROM as storage devices, and a CPU as arithmetic device, for controlling the entire apparatus. The controller 40 includes an image processor 41 and a corrector 42, and is connected to the recorder 11 and image reader 12. The corrector 42 functions as the discharge correcting device of this invention.

The chart 50 described above is printed successively by the recording heads 22, 23, 24 and 25 from the moving direction of the printing paper S when the printing paper S passes under the recorder 11, and its image is read successively by the scanner from the moving direction of the printing paper S when the printing paper S passes under the image reader 12. This chart 50 has the position detecting marks 52 formed at the end, in the transport direction of the printing paper S (Y-direction), of the density area A which serves as the leading end of the density detecting pattern 51 in the transport direction of the printing paper S (Y-direction). Therefore, images of the position detecting marks 52 can be acquired promptly by the image reader 12.

Based on image data acquired by the CCD image sensor forming the image reader 12, the image processor 41 carries out operations including correlating of the respective ink landing positions on the printing paper S with the plurality of nozzles 28, using the position detecting marks 52 of the chart 50.

Using the correlations established by the image processor 41 between the nozzles 28 and the ink landing positions on the printing paper S, the corrector 42 correlates the nozzles 28 and density data (e.g. gray scale values in the image data), described hereinafter, read from the density detecting pattern 51 of the chart 50, calculates correction values of the ink discharge rates of the nozzles 28 for reducing density unevenness among the nozzles 28, and transmits corrected discharge rates to the recorder 11. Consequently, an amount of ink discharged from each nozzle 28 is corrected.

Figure 5:
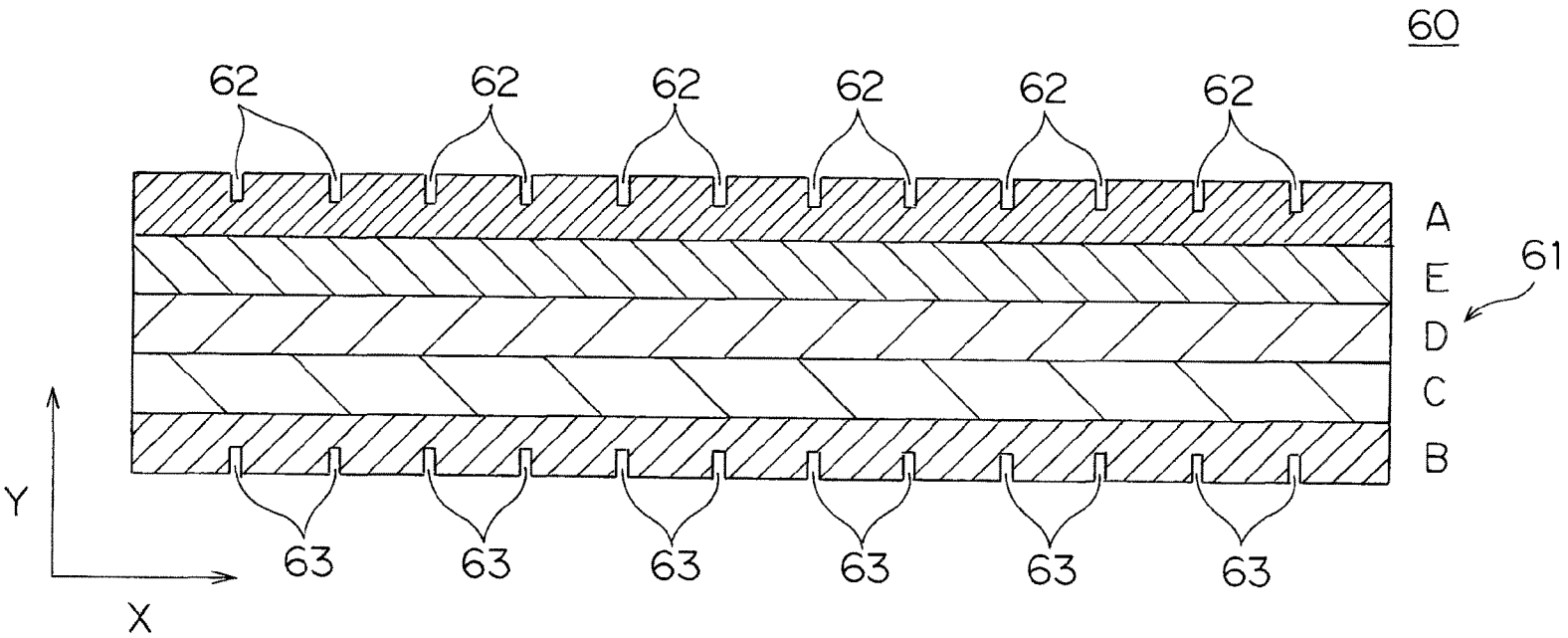
FIG. 5 is an explanatory view of a chart according to another embodiment.
Figure 6:
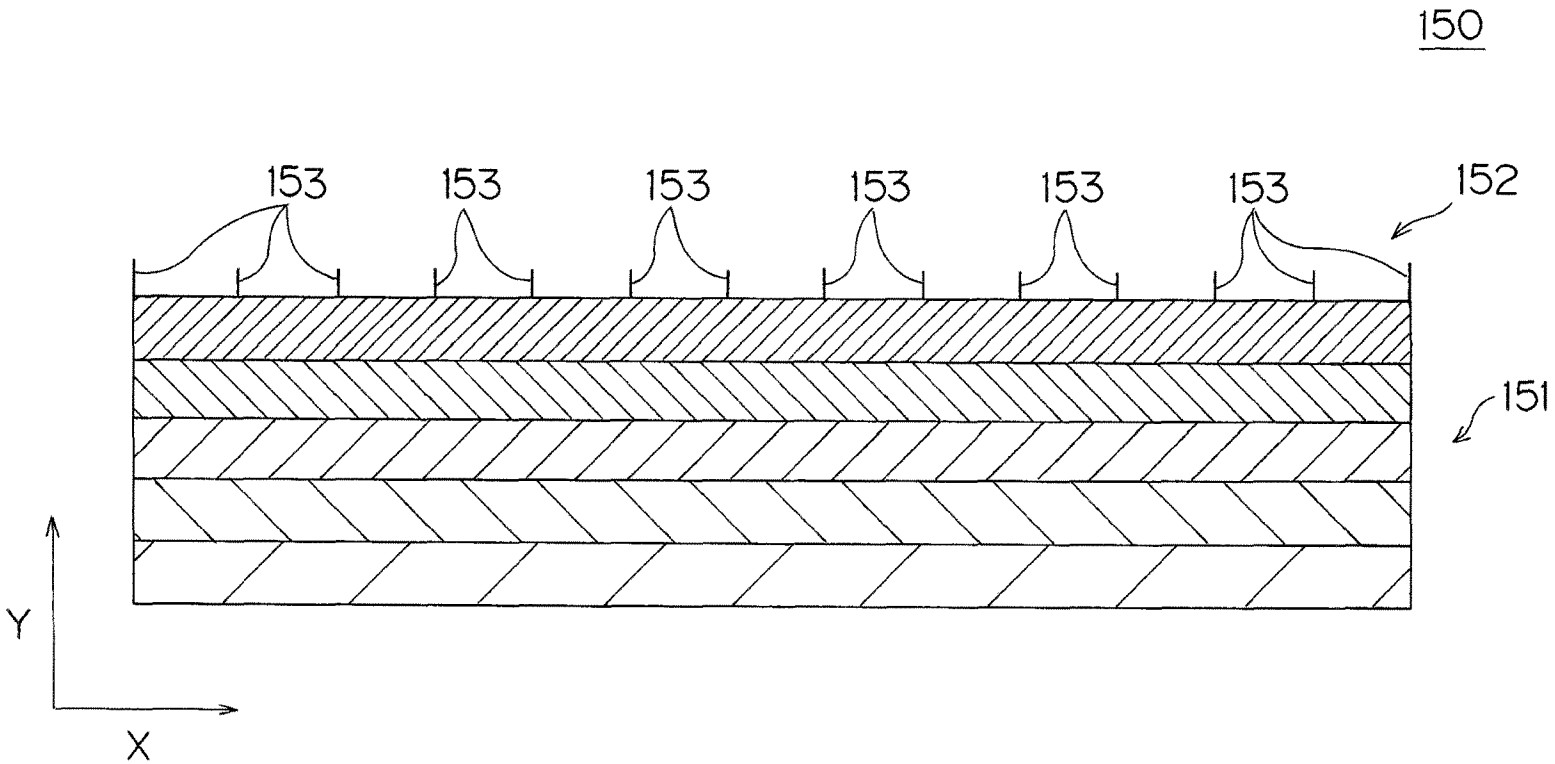
FIG. 6 is an explanatory view of a chart having a position detecting pattern formed therein.

FIG. 5 is an explanatory view of a chart according to another embodiment.

This chart 60 is formed of a density detecting pattern 61 including density areas A, C, D, E and B in form of belts arranged in the stated order in the transport direction of the printing paper S, leading-end position detecting marks 62 formed in the density area A, and rear-end position detecting marks 63 formed in the density area B. The ink discharge rates of the nozzles 28 at the time of recording the density areas A, C, D, E and B of the density detecting pattern 61 in the chart 60 correspond to those at the time of recording the density areas A, B, C, D and E, which have the same letters of the alphabet, of the density detecting pattern 51 in the chart 50 described hereinbefore. The density areas A and B of this chart 60 are the density areas recorded by discharging ink from the nozzles 28 at the rate of 70% or higher.

The chart 60 has the leading-end position detecting marks 62 formed at the end of the density area A which serves as the leading end of the density detecting pattern 61 in the transport direction of the printing paper S (Y-direction), and the rear-end position detecting marks 63 formed at an end of the density area B which serves as the rear end in the transport direction of the printing paper S (Y-direction). Each pair of leading-end position detecting mark 62 and rear-end position detecting mark 63 lying on the same straight line in Y-direction are formed by suspending discharge from the same particular nozzle 28 for fixed periods of time when recording the density areas A and B.

Since this chart 60 includes the leading-end position detecting marks 62 and rear-end position detecting marks 63, when this chart 60 is employed for head shading, it becomes possible to detect oblique movement, rumpling, and so on of the printing paper S easily from a position shifting in X-direction between the leading-end position detecting marks 62 and rear-end position detecting marks 63.

This invention may be embodied in other specific forms without departing from the spirit or essential attributes thereof and, accordingly, reference should be made to the appended claims, rather than to the foregoing specification, as indicating the scope of the invention.

This application claims priority benefit under 35 U.S.C. Section 119 of Japanese Patent Application No. 2011-287196 filed in the Japanese Patent Office on Dec. 28, 2011, the entire disclosure of which is incorporated herein by reference.

What is claimed is:

1. An inkjet image recording apparatus with a recording head having a plurality of nozzles arranged transversely of a recording medium for discharging ink, the recording medium being transported relative to and in a direction perpendicular to a direction of arrangement of the nozzles, the apparatus correcting an ink discharge amount from each nozzle by detecting density of a chart formed by the recording head, the apparatus comprising:

a chart printing device for printing the chart having, recorded therein, a density detecting pattern with a plurality of density areas arranged in the transport direction of the recording medium by discharging the ink from the nozzles toward the recording medium at a different discharge rate for each of the plurality of density areas, and position detecting marks formed in a particular one of the density areas by suspending discharge from particular nozzles selected from the plurality of nozzles;

an imaging device for acquiring an image of the chart; and a discharge correcting device for correcting the ink discharge amount from each nozzle using image data of the chart acquired by the imaging device, wherein the chart printing device is configured such that the chart is printed with one pass of the recording medium being transported in the direction perpendicular to the direction of arrangement of the nozzles, and wherein the chart printing device is further configured such that the position detecting marks are being formed in the particular one of the density areas while the particular one of the density areas is being printed.

2. The inkjet image recording apparatus according to claim 1, wherein:

the recording head is formed of a plurality of inkjet heads each having an arrangement of numerous nozzles for discharging the ink; and the position detecting marks are formed by suspending discharge from at least one of the nozzles of each inkjet head.

3. The inkjet image recording apparatus according to claim 1, wherein the position detecting marks are formed to have a length which is ⅓ to ½ of a length, in the transport direction of the recording medium, of the particular one of the density areas of the density detecting pattern.

4. The inkjet image recording apparatus according to claim 1, wherein the position detecting marks are formed in the particular one, recorded at a discharge rate of at least 70%, of the density areas of the density detecting pattern.

5. The inkjet image recording apparatus according to any one of claims 1 to 4, wherein the position detecting marks are formed in a density area of the density detecting pattern serving as a leading end in the transport direction of the recording medium.

6. The inkjet image recording apparatus according to claim 5, wherein the position detecting marks are formed in the density area of the density detecting pattern serving as the leading end in the transport direction of the recording medium, and in a density area of the density detecting pattern serving as a rear end in the transport direction of the recording medium.

* * * * *